United States Patent [19]

Takeuchi

[11] Patent Number: 4,624,421

[45] Date of Patent: Nov. 25, 1986

[54] REEL

[76] Inventor: Shinobu Takeuchi, 69-2, Aza Minamikawaharada, Motomiyamachi, Adachi-gun, Fukushima-ken, Japan

[21] Appl. No.: 694,044

[22] Filed: Jan. 23, 1985

[30] Foreign Application Priority Data

May 18, 1984 [JP] Japan ..... 59-72021[U]

[51] Int. Cl.[4] ..... B65H 75/22

[52] U.S. Cl. ..... 242/77; 242/115

[58] Field of Search ..... 242/77, 77.4, 115, 116, 242/118.4, 118.41, 118.5, 118.6, 118.61, 73, 77.2, 77.3; 248/222.4, 223.1; 403/154, 155; 411/352, 353, 516, 517, 518, 521, 529

[56] References Cited

U.S. PATENT DOCUMENTS

| | | | |
|---|---|---|---|
| Re. 18,144 | 8/1931 | Heiermann | 411/518 X |
| 1,266,379 | 5/1918 | Anderson | 242/77.4 |
| 1,786,366 | 12/1930 | Rath | 242/77.4 |
| 2,695,142 | 11/1954 | Fous et al. | 242/115 |
| 3,565,363 | 2/1971 | Mizuguchi et al. | 242/115 |
| 4,269,371 | 5/1981 | Koveleski | 242/77 X |
| 4,378,913 | 4/1983 | Föhl | 411/521 X |

FOREIGN PATENT DOCUMENTS

| | | | |
|---|---|---|---|
| 558613 | 8/1923 | France | 242/118.61 |
| 356907 | 9/1931 | United Kingdom | 242/118.4 |

*Primary Examiner*—John M. Jillions

*Attorney, Agent, or Firm*—Holman & Stern

[57] ABSTRACT

A reel molded mainly from synthetic resin which is conveniently structured in a manner that supporting rods are inserted detachably through circumferentially spaced and aligned holes provided through a pair of disc shaped side plates, and a reel collar is pressed between the side plates by the rods to facilitate easily changing the width of the reel by selecting appropriate rods and a reel collar.

5 Claims, 13 Drawing Figures

REEL

BACKGROUND OF THE INVENTION

Field of the Invention

This invention relates to a novel reel which comprises a pair of discs made of synthetic resin and a reel collar and which can be assembled very easily.

In the prior art this type of reel is integrally formed with adhesives or calking and therefore, can not be dismounted. Therefore anglers are required to select an appropriate reel for a particular use depending on the amount of line to be reeled.

As the reel cannot be disassembled, such inconveniences arise as low efficiency in transportation or a large space required for storing empty reels.

BRIEF SUMMARY OF THE INVENTION

This invention was conceived in view of the above mentioned inconveniences encountered in the prior art and has the object of providing a reel of simple structure which can be assembled or disassembled easily.

The second object of this invention is to provide a reel having a reel collar which is adjustable in width depending on the amount of line to be reeled.

The third object of this invention is to provide a reel which can be disassembled to thereby avoid the need of storage space for empty reels as well as to improve transportation efficiency.

These, and other objects will become apparent from the following detailed description with reference to the accompanying drawings wherein.

DETAILED DESCRIPTION

Figure 1:
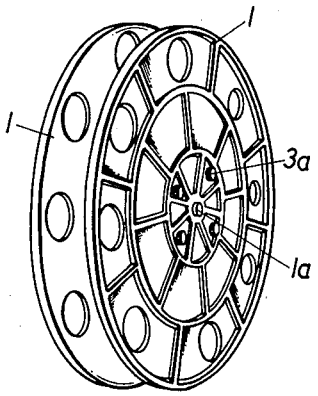
FIG. 1 is a perspective view showing an embodiment of the reel according to this invention.
Figure 2:
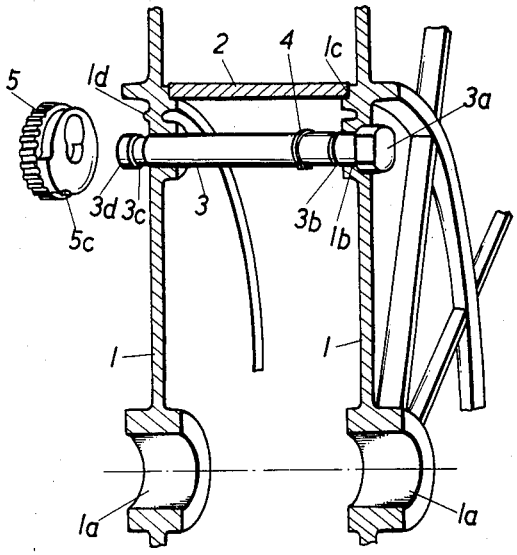
FIG. 2 is a perspective cross-sectional view showing the rod inserting member.
Figure 3:
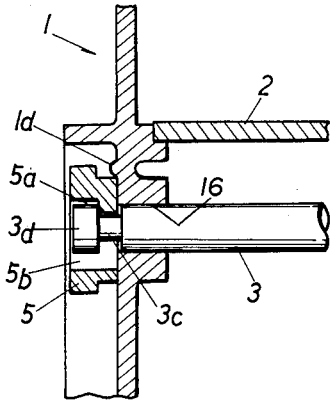
FIG. 3 is a fragmented cross-sectional view showing the manner in which a lock member is mounted on a rod.
Figure 4:
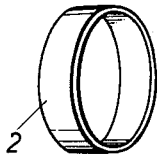
FIG. 4 is a perspective view of a reel collar which is one of the components.
Figure 5:
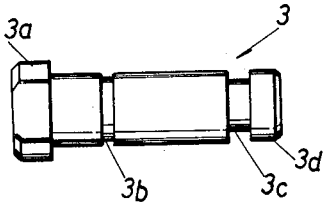
FIG. 5 is an elevational view of the lock member which is a component of the invention.
Figure 6:
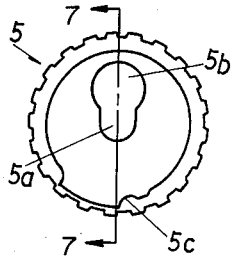
FIG. 6 is a rear elevational view of the lock member.

The reference numerals 1,1 denote a pair of side plates in a disc form which are made of synthetic resin such as plastics. Axial holes 1*a* are bored at the center of said side plates 1. Rod inserting holes 1*b* in an arbitrary number are bored at equal intervals in said discs radially outwardly and circumferentially spaced around axial holes. Projected edges 1*c* are provided on the discs radially outwardly of the rod inserting holes 1*b* to mount a cylindrical reel collar 2 made of similar material between the opposing projections 1*c* of discs (1), (1).

The reel collar 2 is adapted to be fixed by a rod 3 which is inserted detachably through holes 1*b*.

As shown in FIGS. 2 through 7, the rod 3 has an enlarged top 3*a* on one end thereof and has an annular groove 3*b* to engage with a snap ring 4 on the periphery thereof at a predetermined distance from the head 3*a*, a distance from head 3*a* equal to the thickness of a side plate 1 at hole 1*b*. Rod 3 also has a groove of a smaller diameter 3*c* near the other end thereof which forms an engaging head 3*d* on the other end. A rod 3 is inserted into a rod inserting hole 1*b* of one of the side plates 1 and a snap ring 4 is engaged within the annular groove 3*b*. The engaging head 3*d* of the rod 3 is then inserted through a hole 1*b* of the other and is engaged fixedly with a lock member 5 which is a separate component.

The lock member 5 is a flat disc type member and is bored with a small hole 5*a* and a large hole 5*b* at the substantial center and at an eccentric position thereof, respectively, in a manner to communicate with each other. The engaging head 3*d* of the rod 3 is inserted in the larger hole 5*b* and slid into the small hole 5*a* so that the latter is engaged in the groove 3*c*. It can be easily released from such engagement by performing the above steps in reversed order. A portion of the surface on one side of the lock member 5 is raised to form a step 5*c*. The lock member 5 is mounted on the engaging head 3*d* of the rod 3 which projects from the rod inserting hole 1*b* of said side plate 1. A guide member 1*d* projects from the side plate 1 to slidably contact with the periphery of lock member 5. By rotating lock member 5, the step 5*c* is rotated on the surface of the guide member 1*d* until the groove 3*c* of the rod 3 is snapped into the small hole 5*a*. In other words, the lock member 5 is guided and pressed by the guide member 1*d* in the radial direction of the reel so that the groove 3*c* is pressed to fit into the small hole 5*a* for locking.

Figure 9:
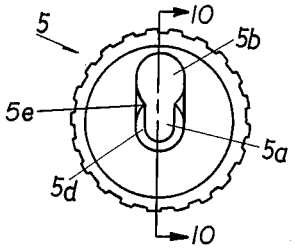
FIG. 9 is a front elevational view of a lock member which is a component of the invention.
Figure 7:
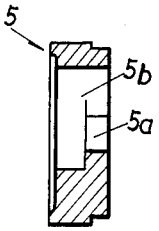
FIG. 7 is a cross-sectional view taken along line 7—7 of FIG. 6.
Figure 10:
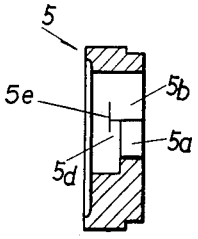
FIG. 10 is a cross-sectional view taken along line 10—10 of FIG. 9.
Figure 8:
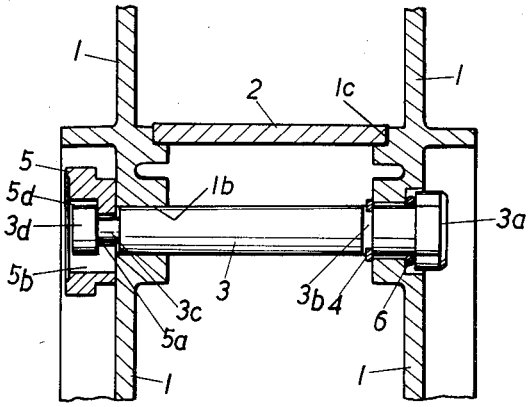
FIG. 8 is a fragmented cross-sectional view of a rod inserting member of another embodiment.
Figure 11:
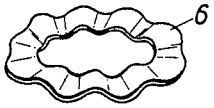
FIGS. 11, 12 and 13 are perspective views showing respectively different embodiments of resilient members.
Figure 12:
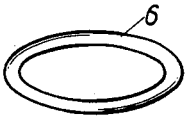
Figure 13:
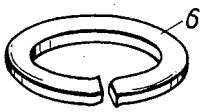

FIGS. 8 through 10 show another embodiment wherein a lock member 5 is bored with a small hole 5*a* and a large hole 5*b* at the substantial center and at an eccentric position of the disc, respectively, the two holes communicating with each other. An engaging head 3*d* is inserted through the large hole 5*b* in a manner to be slid into the small hole 5*a* through the groove 3*c* thereof. A recess 5*d* is cut on the periphery of the small hole 5*a* for engaging with an engaging head 3*d*. Therefore, if such lock member 5 is mounted on the engaging head 3*d* of the rod which is inserted through the large hole 5*b* and projects from the rod inserting hole 1*b*, and an annular resilient member 6 is inserted between an enlarged head 3*a* of the rod 3 and a side plate 1, and the lock member 5 is slid along the other side plate 1 to position the groove 3*c* within the small hole 5*a*, the rod is resiliently urged in the direction of the enlarged top 3*a*, to thereby eliminate looseness between the rod 3 and the side plates as well as to press and engage the engaging head 3*d* within the recess 5*d* formed by the periphery of the small hole 5*a* of the lock member 5. FIGS. 11 through 13 show respectively a steel corrugated washer as alternative resilient members 6, a rubber O-ring, and a spring washer.

Due to the unique structure and especially the fact that a pair of synthetic side plates in disc form 1, 1, a reel collar 2 and a rod 3 are easily assembled to form an integral body, this invention provides a reel which is adjustable in width depending on the amount of line to be reeled thereon simply by selecting appropriate lengths of the reel collar and the rod.

As the reel according to this invention can be easily disassembled or assembled by means of the lock member 5, empty reels may be dismounted to save storage space as well as to improve transportability.

Due to the reinforcement with a supporting rod 3, the disadvantage of brittleness of synthetic resin such as plastics is improved effectively and the durability of the reel is enhanced.

As the reel according to this invention is made of synthetic resin such as plastics which is easily dyed, the side plate, or plates 1 may be colored so as to facilitate product management.

As described in the foregoing, this invention provides a novel and practically effective reel.

I claim:

1. A reel comprising:

a pair of spaced side plates each having the form of a disc made of synthetic resin;

aligned axial holes in said side plates to provide an axis of rotation for the reel;

a plurality of pairs of aligned rod inserting holes in said side plates radially spaced outwardly with respect to said axial holes and circumferentially spaced with respect to each other;

reel collar engaging steps on the inner facing surfaces of said side plates;

a cylindrical reel collar inserted between said side plates and engaging at its ends with said steps for spacing said side plates apart;

a rod member removably insertable in each aligned pair of rod inserting holes;

removable locking means at one end of each rod member for retaining said rod member engaged with said side plates; and means at the other end of each rod member for resiliently urging said side plates toward each other to retain said reel collar therebetween.

2. The reel as claimed in claim 1 wherein:

an enlarged head is provided on said other end of each rod member larger in size than said rod inserting holes;

a first annular groove adjacent said one end of said rod member;

a snap ring groove in said rod member adjacent said enlarged head;

a snap ring engageable in said snap ring groove to retain said rod member on the adjacent side plate; and said removable locking means comprises a locking disc, a central hole in said locking disc having a diameter larger than the diameter of said first annular groove to receive said annular groove therein and smaller than the diameter of said rod member, a second hole in said locking disc eccentric with respect to said central hole and merging therewith and having a diameter larger than the diameter of said rod member to receive said rod member therein, and means to urge said locking disc upon rotation thereof so that said locking disc is slid with respect to said rod member and the adjacent side plate for engaging said central hole in said annular groove.

3. A reel as claimed in claim 1 wherein said means for resiliently urging said side plates toward each other comprises:

an enlarged head on said other end of each rod member having a larger diameter than said rod inserting holes; and a resilient ring shaped member between said enlarged head and the adjacent side plate.

4. A reel as claimed in claim 2 wherein said means for resiliently urging said side plate toward each other comprises:

a resilient ring shaped member between said enlarged head and the adjacent side plate.

5. A reel as claimed in claim 2 wherein said means to urge said locking disc comprises:

a protruding guide member on the outer surface of the side plate adjacent said one end of each rod and radially spaced from the respective axial hole; and a shifting step on a peripheral surface of said locking disc operatively engageable with said guide member, so that upon rotation of said locking disc when said shifting step engages said guide member, said guide member shifts said locking disc substantially radially.

* * * * *